US009261831B2

(12) United States Patent
Matsuno

(10) Patent No.: US 9,261,831 B2
(45) Date of Patent: Feb. 16, 2016

(54) IMAGE FORMING APPARATUS AND HEAT FIXING DEVICE PROVIDED IN THE SAME

(71) Applicant: Brother Kogyo Kabushiki Kaisha, Nagoya-shi, Aichi-ken (JP)

(72) Inventor: Takuji Matsuno, Ichinomiya (JP)

(73) Assignee: Brother Kogyo Kabushiki Kaisha, Nagoya-shi,Aichi-ken (JP)

( * ) Notice: Subject to any disclaimer, the term of this patent is extended or adjusted under 35 U.S.C. 154(b) by 0 days.

(21) Appl. No.: 14/226,841

(22) Filed: Mar. 27, 2014

(65) Prior Publication Data

US 2014/0294417 A1 Oct. 2, 2014

(30) Foreign Application Priority Data

Mar. 28, 2013 (JP) ..... 2013-070009

(51) Int. Cl.
*G03G 15/20* (2006.01)

(52) U.S. Cl.
CPC .... *G03G 15/2042* (2013.01); *G03G 2215/2035* (2013.01)

(58) Field of Classification Search
CPC ..... G03G 15/2039; G03G 15/2042; G03G 2215/2035
See application file for complete search history.

(56) References Cited

U.S. PATENT DOCUMENTS 6,519,426 B2 2/2003 Goto et al.
6,647,217 B2 * 11/2003 Tomatsu ..... 399/33
6,950,616 B2 9/2005 Saito et al.
7,620,338 B2 * 11/2009 Yamada et al. ..... 399/70
7,907,870 B2 * 3/2011 Haseba et al. ..... 399/122
8,027,607 B2 * 9/2011 Kurata et al. ..... 399/69
8,346,106 B2 1/2013 Takenaka et al.
2002/0003970 A1 1/2002 Goto et al.
2004/0190924 A1 * 9/2004 Iwasaki et al. ..... 399/68
2004/0197112 A1 10/2004 Saito et al.
2005/0175367 A1 8/2005 Urabe
2007/0059001 A1 3/2007 Matsuura et al.

(Continued)

FOREIGN PATENT DOCUMENTS

CN 1497390 A 5/2004
JP 2006-251068 A 9/2006

(Continued)

OTHER PUBLICATIONS

Dec. 4, 2014—(US) Non-Final Office Action—U.S. Appl. No. 14/226,859.

(Continued)

*Primary Examiner* — Sandra Brase
(74) *Attorney, Agent, or Firm* — Banner & Witcoff, Ltd.

(57) ABSTRACT

An image forming apparatus includes an endless belt, a heater, a first temperature sensor, a second temperature sensor, and a controller. The endless belt has a center portion and end portions in an axial direction, and defines an internal space therein and an outer peripheral surface. The first temperature sensor is positioned at the center portion and facing the outer peripheral surface. The second temperature sensor is positioned at one of the end portions and in the internal space. The controller is configured to: receive a first signal from the first temperature sensor; control the heater based on the first signal; receive a second signal from the second temperature sensor; and determine whether an edge overheat occurs at the one of the end portions based on the second signal.

29 Claims, 11 Drawing Sheets

(56) References Cited

U.S. PATENT DOCUMENTS

| | | | | |
|---|---|---|---|---|
| 2009/0052927 | A1* | 2/2009 | Yoshikawa | 399/69 |
| 2011/0020018 | A1 | 1/2011 | Takenaka et al. | |
| 2011/0150544 | A1* | 6/2011 | Ishida et al. | 399/328 |
| 2011/0158719 | A1 | 6/2011 | Miyauchi et al. | |
| 2012/0251138 | A1* | 10/2012 | Ishida et al. | 399/33 |
| 2013/0034362 | A1 | 2/2013 | Matsuura et al. | |
| 2014/0294419 | A1 | 10/2014 | Matsuno | |

FOREIGN PATENT DOCUMENTS

| | | | |
|---|---|---|---|
| JP | 2011-028037 | A | 2/2011 |
| JP | 2011-113016 | A | 6/2011 |
| JP | 2012-133281 | A | 7/2012 |

OTHER PUBLICATIONS

Mar. 19, 2015—(US) Final Office Action—U.S. Appl. No. 14/226,859.

Oct. 7, 2015—(US)—Non-Final Office Action—U.S. Appl. No. 14/226,859.

Nov. 2, 2015—(CN) Notification of First Office Action—App 201410119548.8, Eng Tran.

Oct. 10, 2015—(CN) Notification of First Office Action—App 201410120590.1, Eng Tran.

* cited by examiner

IMAGE FORMING APPARATUS AND HEAT FIXING DEVICE PROVIDED IN THE SAME

CROSS REFERENCE TO RELATED APPLICATION

This application claims priority from Japanese Patent Application No. 2013-070009 filed Mar. 28, 2013. The entire content of the priority application is incorporated herein by reference.

TECHNICAL FIELD

The present invention relates to a heat fixing device having a temperature sensor, and an image forming apparatus having the heat fixing device.

BACKGROUND

A heat fixing device provided in an image forming apparatus is disclosed in Japanese Patent Application Publication No. 2006-251068. The heat fixing device includes an endless belt having a center portion and end portions in an axial direction thereof, a heater disposed within the endless belt, and a temperature sensor that faces the center portion of an outer peripheral surface of the endless belt. This configuration allows the temperature sensor to efficiently detect the temperature of the outer peripheral surface of the endless belt.

SUMMARY

However, the heat fixing device is not provided with a temperature sensor at the end portions of the endless belt. Therefore, an excessive rise in temperature at the end portions of the endless belt (referred to as edge overheat, hereinafter) cannot be detected.

In view of the foregoing, it is an object of the present invention to provide an image forming apparatus that can detect an edge overheat of an endless belt.

In order to attain the above and other objects, the present invention provides an image forming apparatus. The image forming apparatus may include an endless belt, a heater, a first temperature sensor, a second temperature sensor, and a controller. The endless belt may be configured to circularly move about a rotational axis extending in an axial direction. The endless belt may have a center portion and end portions in the axial direction, and define an internal space therein and an outer peripheral surface. The heater may be configured to heat the endless belt. The first temperature sensor may be positioned at the center portion and facing the outer peripheral surface. The second temperature sensor may be positioned at one of the end portions and in the internal space. The controller may be configured to: receive a first signal from the first temperature sensor; control the heater based on the first signal; receive a second signal from the second temperature sensor; and determine whether an edge overheat occurs at the one of the end portions based on the second signal.

According to another aspect, the present invention provides a heat fixing device. The heat fixing device may include an endless belt, a nip member, a first temperature sensor, and a second temperature sensor. The endless belt may be configured to circularly move about a rotational axis extending in an axial direction. The endless belt may have a center portion and end portions in the axial direction and defines an internal space therein, an inner peripheral surface, and an outer peripheral surface. The nip member may be configured to contact the inner peripheral surface of the endless belt. The first temperature sensor may be positioned at the center portion and facing the outer peripheral surface. The second temperature sensor may be positioned at one of the end portions and in the internal space.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
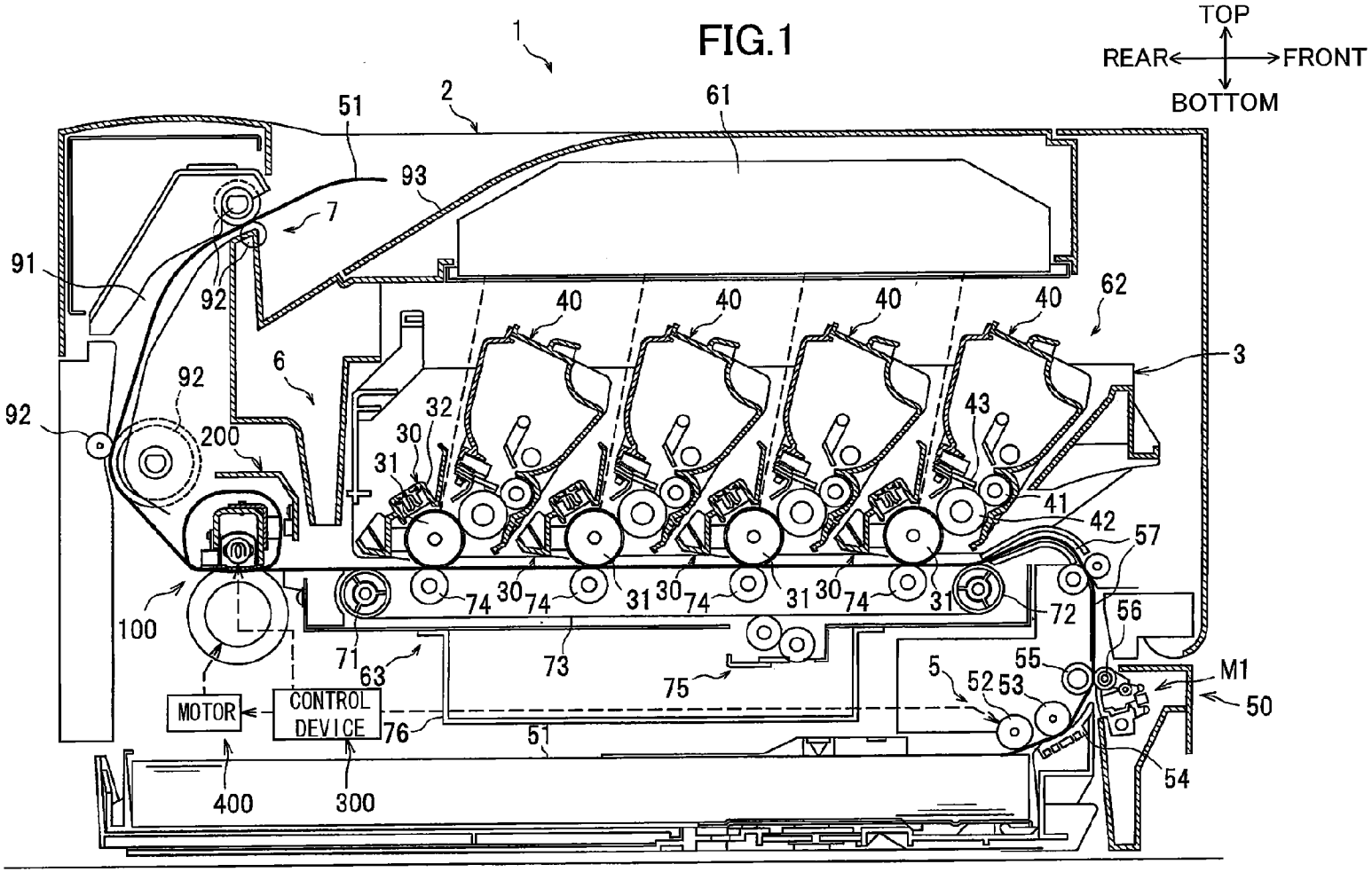
FIG. 1 is a schematic cross-sectional view of a color laser printer according to an embodiment of the invention.

An embodiment of the present invention will be described in detail with reference to the accompanying drawings. In the following description, the top-bottom direction shown in FIG. 1 is referred to as a top-bottom direction; the left side of FIG. 1 is referred to as a rear side, the right side as a front side, the far side of the sheet as a right side, and the near side of the sheet as a left side. In this case, the directions are defined based on directions as viewed from a front side of a color laser printer 1.

<Schematic Configuration of Color Laser Printer>

As shown in FIG. 1, the color laser printer 1 includes a device body 2, a paper feed unit 5 adapted to feed sheets 51, an image formation unit 6 adapted to form an image on the fed sheet 51, a paper discharge unit 7 adapted to discharge the sheet 51 on which the image has been formed, a control device 300; and a motor 400. These components are provided in the device body 2. The control device 300 and the motor 400 will be described later.

The paper feed unit 5 includes a paper feed tray 50 and a conveyance mechanism M1. The paper feed tray 50 is slidingly attached to and detached from the device body 2 from a front side at a lower portion of the device body 2. The conveyance mechanism M1 lifts up a front side of the sheet 51 from the paper feed tray 50 and conveys the sheet 51 so as to turn the sheet 51 rearward.

The conveyance mechanism M1 includes a pickup roller 52, a separation roller 53, and a separation pad 54, which are provided at a front end portion of the paper feed tray 50. Those components are adapted to separate one sheet 51 after another, and send the sheet 51 upward. As the sheet 51 that has been sent upward passes between a paper dust removing roller 55 and a pinch roller 56, paper dust is removed from the sheet 51. Subsequently, the sheet 51 travels along a conveyance route 57 while turning to the rear side. Then, the sheet 51 is fed onto a conveyance belt 73, and is conveyed to a fusing belt 110.

The image formation unit 6 includes a scanner unit 61, a process unit 62, a transfer unit 63, and a heat fixing device 100.

The device body 2 has an upper portion provided with the scanner unit 61 including a laser emitting unit, a polygon mirror, a plurality of lenses and reflective mirrors (not shown in the drawings). Laser beams for each of the colors, cyan, magenta, yellow, and black, are emitted from the laser emitting unit in the scanner unit 61, scans at high speed by the polygon mirror in a right-left direction, and then irradiates each photosensitive drum 31 after passing through or reflected by a plurality of lenses and reflective mirrors.

The process unit 62 is placed below the scanner unit 61 and above the paper feed unit 5. The process unit 62 includes a photosensitive unit 3 that is movable in a front-rear direction with respect to the device body 2. The photosensitive unit 3 includes four drum subunits 30 and developing cartridges 40. The drum subunits 30 are provided at a lower portion of the photosensitive unit 3, and each of the developing cartridges 40 is detachably mounted on each drum subunit 30.

Each drum subunit 30 includes a photosensitive drum 31 and a scorotron-type charger 32. Each developing cartridge 40 accommodates therein toner and includes a supply roller 41, a developing roller 42, and a layer thickness regulating blade 43.

The process unit 62 functions as described below. The supply roller 41 supplies the toner in the developing cartridge 40 to the developing roller 42. At this time, the toner is positively and frictionally charged between the supply roller 41 and the developing roller 42. The toner supplied to the developing roller 42 is regulated by the layer thickness regulating blade 43 as the developing roller 42 is rotated. As a result, the toner is curried on a peripheral surface of the developing roller 42 as a uniform thin layer.

The photosensitive drum 31 is uniformly and positively charged by corona discharge of the scorotron-type charger 32 in the drum subunit 30. The charged photosensitive drum 31 is irradiated with the laser beam emitted from the scanner unit 61 to form an electrostatic latent image corresponding to an image to be formed on the sheet 51 on the photosensitive drum 31.

Furthermore, as the photosensitive drum 31 rotates, the toner carried on the developing roller 42 is supplied to the electrostatic latent image of the photosensitive drum 31, e.g., to a portion of the surface of the positively charged photosensitive drum 31 whose potential is lowered due to the exposure of the laser beams. As a result, the electrostatic latent image of the photosensitive drum 31 is developed into a visible image, and a toner image is held on the peripheral surface of the photosensitive drum 31 for each color of the toner by reversal phenomena.

The transfer unit 63 includes a drive roller 71, a driven roller 72, an endless conveyance belt 73, transfer rollers 74, and a cleaning unit 75. The drive roller 71 and the driven roller 72 are separated in the front-rear direction, and are disposed parallel to each other. The conveyance belt 73 is looped around the drive roller 71 and the driven roller 72. The conveyance belt 73 has an outer surface in contact with each photosensitive drum 31. The conveyance belt 73 defines an internal space therein provided with the transfer rollers 74 so that the conveyance belt 73 is sandwiched between the photosensitive drum 31 and the transfer roller 74. The transfer rollers 74 are applied with a transfer bias from a high-voltage board not shown in the drawings. During the formation of the image, the sheet 51 conveyed by the conveyance belt 73 is held between the photosensitive drums 31 and the transfer rollers 74, and the toner images on each of the photosensitive drums 31 are transferred and superimposed onto the sheet 51.

The cleaning unit 75 is placed below the conveyance belt 73. The cleaning unit 75 removes the toner adhering to the conveyance belt 73, and collects the removed toner into a toner storage unit 76 disposed below the cleaning unit 75.

The heat fixing device 100 is provided rearward of the transfer unit 63. The heat fixing device 100 thermally fixes on the sheet 51 the toner images that have been transferred onto the sheet 51. The heat fixing device 100 will be described later.

The paper discharge unit 7 defines a discharge path 91 of the sheet 51 extending from an outlet of the heat fixing device 100 toward upward and then turning frontward. A plurality of conveyance rollers 92 is disposed in the middle of the discharge path 91 to carry the sheets 51. A paper discharge tray 93 is formed on an upper surface of the device body 2. The sheet 51 discharged by the conveyance rollers 92 from the discharge path 91 is stacked on the paper discharge tray 93.

<Detailed Configuration of Heat Fixing Device>

Figure 2:
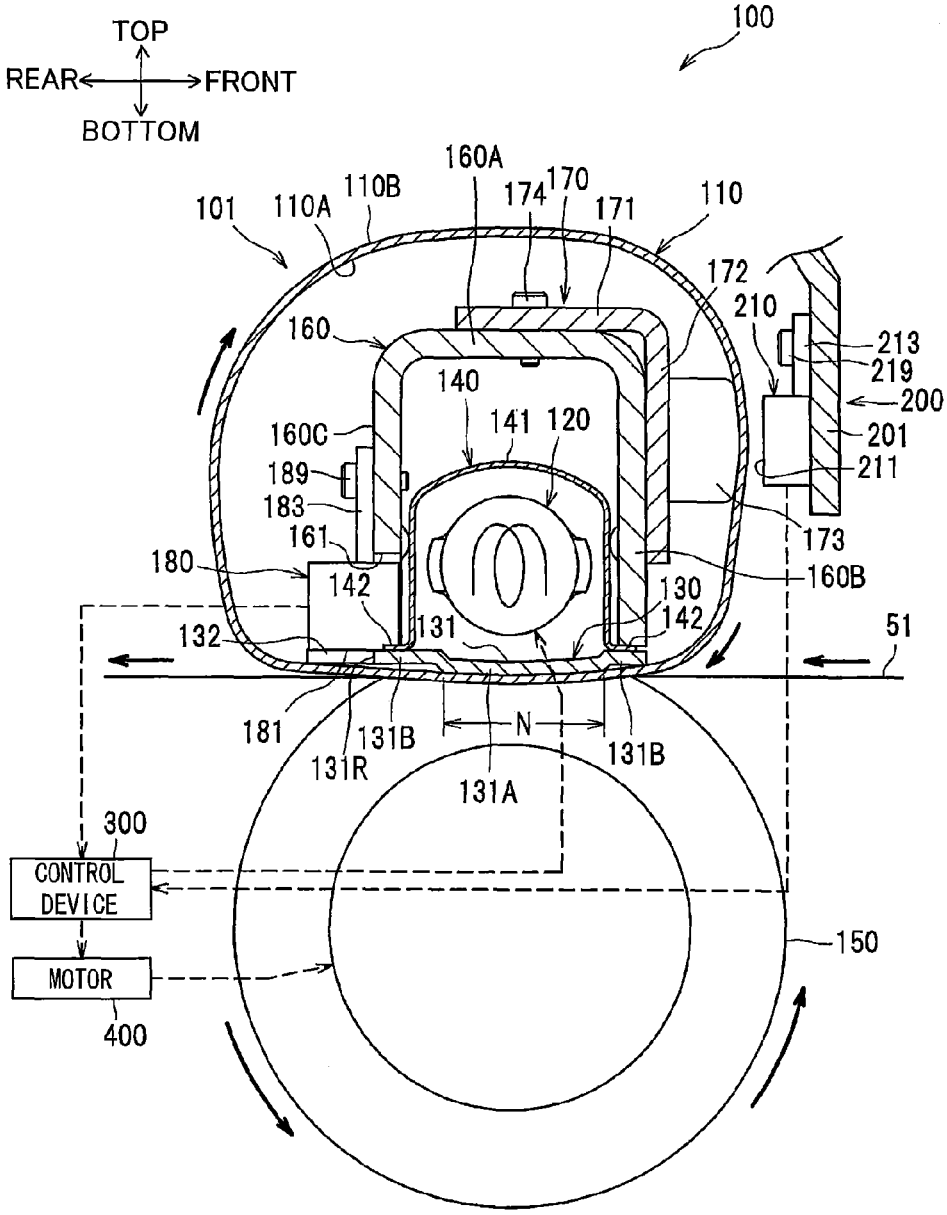
FIG. 2 is a schematic cross-sectional of a heat fixing device of the color laser printer.

As shown in FIG. 2, the heat fixing device 100 includes a heating member 101, a pressure roller 150 as an example of a rotation member, a fixing frame 200, and a center thermistor 210 as an example of a first temperature sensor.

Figure 3:
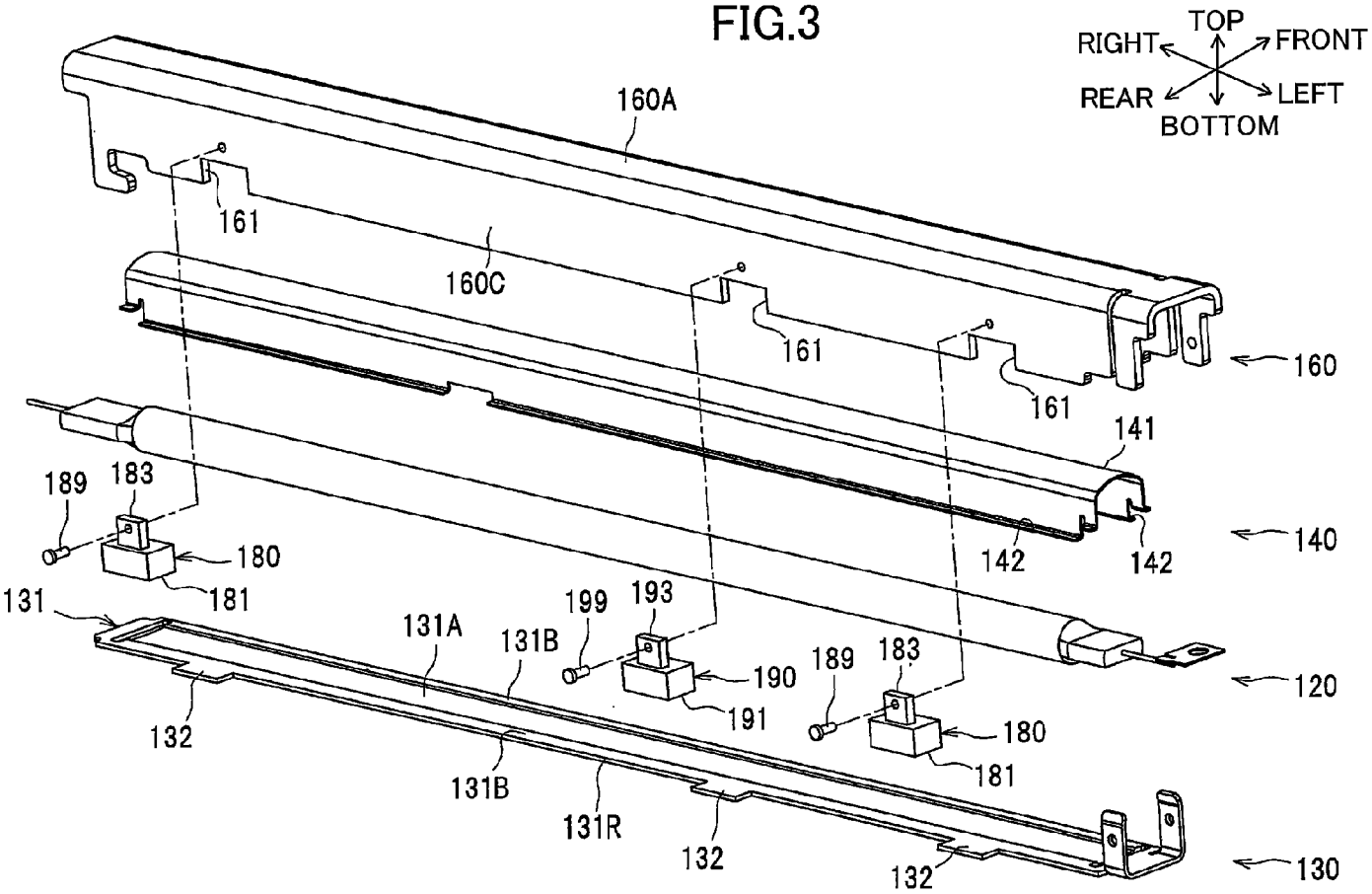
FIG. 3 is an exploded perspective view of a halogen lamp, a nip plate, a reflective plate, a stay, side thermistors, and a thermostat.

The heating member 101 includes a fusing belt 110 as an example of an endless belt, a halogen lamp 120 as an example of a heater, a nip plate 130 as an example of a nip member, a reflective plate 140, a stay 160, a cover member 170, a pair of side thermistors 180 as an example of a second temperature sensor and a third temperature sensor, and a thermostat 190 as an example of an overheat prevention member (See FIG. 3).

The fusing belt 110 is an endless belt having heat resistance and flexibility and defines an internal space therein in which above components are disposed. The fusing belt 110 contacts the pressure roller 150 so as to follow the same, thereby circularly moving in the clockwise direction in FIG. 2, i.e. moving rearward at a nip N described later. The fusing belt 110 rotates about an axis extending in the right-left direction, and has an inner peripheral surface 110A in sliding contact with the nip plate 130 and an outer peripheral surface 110B in sliding contact with the pressure roller 150. The fusing belt 110 comprises a metal element tube made of stainless steel or the like. The fusing belt 110 may include a rubber layer covering a surface of the metal element tube, and may further include a non-metallic mold release layer such as fluorine coating for covering a surface of the rubber layer.

The halogen lamp 120 is a separate member from the nip plate 130. The halogen lamp 120 functions as a heating body for heating the toner on the sheet 51 by heating the nip plate 130 and the fusing belt 110. The halogen lamp 120 is disposed in the internal space of the fusing belt 110 with a predetermined gap from inner peripheral surface 110A of the fusing belt 110 and the nip plate 130, i.e., separated from the inner peripheral surface 110A of the fusing belt 110 and the nip plate 130.

The nip plate 130 is a plate-like member for receiving radiation heat from the halogen lamp 120, and is in sliding contact with the inner peripheral surface 110A of the fusing belt 110. The nip plate 130 transmits the radiation heat received from the halogen lamp 120 to the toner on the sheet 51 via the fusing belt 110. The nip plate 130 is made of, for example, an aluminum plate having larger thermal conductivity than the stay 160 made of steel. The nip plate 130 mainly includes a base section 131 and protruding sections 132 shown in FIG. 3.

The base section 131 has a central section 131A and end portions 131B in a conveyance direction of the sheet 51. The central section 131A has a convex shape protruding from both end portions 131B toward the pressure roller 150.

The protruding sections 132 protrude rearward from a rear end 131R of the base section 131 in the conveyance direction. As shown in FIG. 3, three protruding sections 132 are formed in the nip plate 130. Specifically, two protruding sections 132 are formed in both end portions of the rear end 131R in the right-left direction, and the remaining protruding section 132 is formed at a position slightly closer to the left side than the center in the right-left direction.

As shown in FIG. 2, the reflective plate 140 is a member adapted to reflect the radiation heat mainly emitted from the halogen lamp 120 in the front-rear direction and top direction to the nip plate 130, e.g., an inner surface of the base section 131. The reflective plate 140 is disposed in the internal space of the fusing belt 110 so as to surround the halogen lamp 120 with a predetermined gap therebetween.

The reflective plate 140 concentrates the radiation heat from the halogen lamp 120 on the nip plate 130. Therefore, the radiation heat from the halogen lamp 120 can be efficiently utilized, allowing the nip plate 130 and the fusing belt 110 to be quickly heated.

The reflective plate 140 is formed by bending, for example, an aluminum plate having a high reflectance to infrared rays and far infrared rays or any other plate into an almost U-shape in cross-section. More specifically, the reflective plate 140 mainly includes a reflective section 141 having a curved shape (substantially U-shape in cross-section) and flange sections 142 outwardly extending from both end portions of the reflective section 141 in the front-rear direction. The reflective plate 140 may be made from a mirror-finished aluminum plate to increase heat reflectance.

The stay 160 is a member that enhances the rigidity of the nip plate 130 by supporting both end portions 131B of the base section 131 of the nip plate 130 through the flange sections 142 of the reflective plate 140. The stay 160 is so placed as to cover the reflective plate 140 from above. More specifically, the stay 160 has a U-shaped cross-section including an upper wall 160A, a front wall 160B, and a rear wall 160C. The upper wall 160A has a front end form which the front wall 160B extends downward and a rear end from which the rear wall 160C extends downward.

As shown in FIG. 3, the stay 160 is formed with three notches 161 on the rear wall 160C to allow the side thermistors 180 to be placed therein with a gap therebetween. More specifically, the notches 161 are formed at positions corresponding to the three protruding sections 132 of the nip plate 130.

Figure 4A:
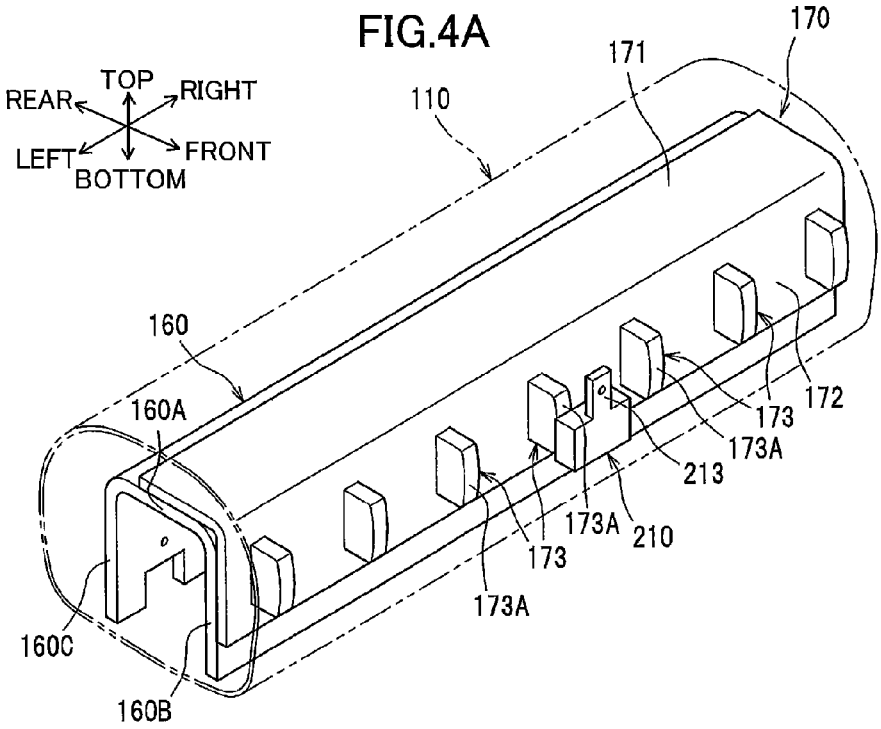
FIG. 4A is a schematic perspective view of the stay, a cover member, and a center thermistor.
Figure 4B:
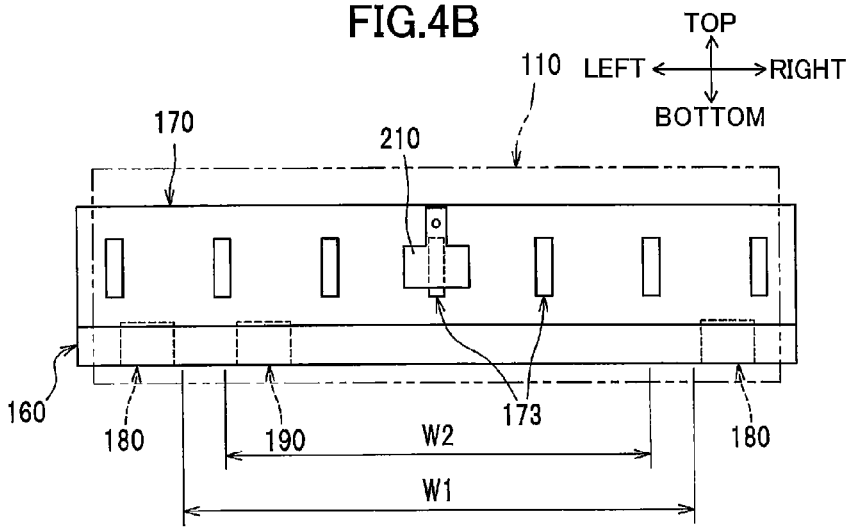
FIG. 4B is a front view of the stay, the cover member, and the center thermistor.

As shown in FIGS. 4A and 4B, the cover member 170 is disposed for covering the upper wall 160A and the front wall 160B of the stay 160. The cover member 170 includes an upper-side wall 171 and a front-side wall 172 extending downward from a front end of the upper-side wall 171. The front-side wall 172 has a front surface provided with a plurality of ribs 173. The upper-side wall 171 can be fixed to the upper wall 160A of the stay 160 with a screw 174 as shown in FIG. 2.

Seven ribs 173 in total are provided on the front surface of the front-side wall 172 in the right-left direction at equal intervals so as to protrude from the front surface of the front-side wall 172 toward the front side. Each rib 173 is formed into generally square shape and has a front surface as a guide surface 173A for guiding the inner peripheral surface 110A of the fusing belt 110. The center rib 173 of the plurality of ribs 173 is opposite to the center thermistor 210 with respect to the fusing belt 110.

As shown in FIGS. 2 and 3, a pair of side thermistors 180 is contact-type thermistors, and is adapted to detect a temperature of the nip plate 130. More specifically, each side thermistor 180 is positioned at internal space of the right and left end portions of the fusing belt 110, and is positioned outside of a maximum paper width W1 (See FIG. 4B) in the right-left direction. Each side thermistor 180 is adapted to output an end-portion temperature TS as signals to the control device 300. Each side thermistor 180 has an upper portion provided with a fixing rib 183 protruding upward. The fixing rib 183 is fixed to the rear wall 160C of the stay 160 with a screw 189. Each side thermistor 180 is disposed so as to face an upper surface of the protruding section 132 of the nip plate 130, and has a bottom surface as a temperature detection surface 181 for detecting a temperature in contact with the upper surface of the protruding section 132. The side thermistors 180 may be noncontact-type thermistors and be disposed away from the nip plate 130, or may be infrared sensors. The maximum paper width W1 is a maximum width of paper sheet that can be printed in the color laser printer 1.

The thermostat 190 is a temperature detection element using bimetal and is disposed so as to detect the temperature of the nip plate 130. More specifically, the thermostat 190 is placed in an area slightly closer to the left side than the center portion of the fusing belt 110 in the right-left direction, and is positioned an inner side of a minimum paper width W2 in the right-left direction (See FIG. 4B). The thermostat 190 has an upper portion provided with a fixing rib 193 protruding upward. The fixing rib 193 is fixed to the rear wall 160C of the stay 160 with a screw 199. The minimum paper width W2 is a minimum width of paper sheet that can be printed in the color laser printer 1.

The thermostat 190 is disposed so as to face an upper surface of the protruding section 132 of the nip plate 130 and has a bottom surface as a temperature detection surface 191 in contact with the upper surface of the protruding section 132. The thermostat 190 is provided on a circuit that supplies power to the halogen lamp 120. If the thermostat 190 detects a temperature larger than or equal to a predetermined value, then the thermostat 190 interrupts the supply of power to the halogen lamp 120, thereby preventing an excessive rise in the temperature of the heat fixing device 100.

The pressure roller 150 is in sliding contact with the outer peripheral surface 110B of the fusing belt 110 so as to form the nip N therebetween. The pressure roller 150 is disposed immediately below the nip plate 130 and sandwiches the fusing belt 110 in cooperation with the nip plate 130.

The fixing frame 200 is disposed so as to cover the heating member 101 from diagonally upward and frontward of the same, as shown in FIG. 1. The fixing frame 200 has a front wall 201 in front of the heating member 101, and the front wall 201 is provided with the center thermistor 210.

The center thermistor 210 is a noncontact-type thermistor and has an upper portion provided with a fixing rib 213 extending upward. The fixing rib 213 is fixed to the front wall 201 of the fixing frame 200 with a screw 219. The center thermistor 210A has a rear surface as a temperature detection surface 211 in confrontation with the outer peripheral surface 110B with a gap therebetween.

More specifically, as shown in FIGS. 2, 4A, and 4B, the temperature detection surface 211 of the center thermistor 210 is disposed on a front side of the nip N, i.e. on an upstream side of the moving-direction (rotational direction) of fusing belt 110 relative to the nip N. The center thermistor 210 faces a center portion of the outer peripheral surface 110B of the fusing belt 110 in the right-left direction. The fact that the center thermistor 210 faces the center portion of the outer peripheral surface 110B of the fusing belt 110 means that the temperature detection surface 211 is close to the outer peripheral surface 110B capable of detecting the temperature of the outer peripheral surface 110B of the fusing belt 110.

The center thermistor 210 is disposed on the inner side of the minimum paper width W2 in the right-left direction. The center thermistor 210 may be a contact-type thermistor in direct contact with the fusing belt 110, or an infrared sensor. The center thermistor 210 is adapted to output a center temperature TC as signals to the control device 300. The center thermistor 210 and the side thermistors 180 may generate analog values corresponding to the temperatures, or generate digital values based on the analog values. The analog or digital values are transmitted to the control device 300 as signals.

<Control Device>

The control device 300 will be described in detail. The control device 300 includes, for example, a storage unit having a CPU (Central Processing Unit), a ROM (Read Only Memory), and a RAM (Random Access Memory). The control device 300 is adapted to control the halogen lamp 120, the pickup roller 52, and the motor 400 by performing arithmetic process, based on previously prepared programs and the signals from each side thermistor 180 and the center thermistor 210. The signals may represent the temperatures acquired by the side thermistors 180 and the center thermistor 210. The ROM stores instructions for executing various control processes (described later) as programs. The CPU reads the instructions from the ROM, and performs various arithmetic processes.

The control device 300 controls the halogen lamp 120 based on signals from the center thermistor 210. For example, the control device 300 controls the halogen lamp 120 to maintain the output of the halogen lamp 120 constant until the center temperature TC obtained from the center thermistor 210 reaches a target temperature TH0. After the center temperature TC reaches the target temperature TH0, the control device 300 controls the halogen lamp 120 to maintain the center temperature TC at the target temperature TH0. The target temperature TH0 is a temperature within a range where a favorable heat fixing can be performed. The target temperature TH0 can be arbitrarily determined based on results of experiments or simulation. According to the present embodiment, TH0=180 degrees Celsius. The target temperature TH0 may be preferably any value within the range of 160 to 240 degrees Celsius, depending on characteristics of the heat fixing device 100, and be more preferably any value within the range of 175 to 200 degrees Celsius.

The control device 300 determines based on signals from each side thermistor 180 that a failure has occurred, i.e., an edge overheat has occurred, if the end-portion temperature TS, that is, the temperature of the nip plate 130, obtained from at least one of side thermistors 180 is larger than or equal to a first temperature TH1 higher than the target temperature TH0. The first temperature TH1 is higher than temperatures at which the favorable fixing operation can be performed. The first temperature TH1 can be arbitrarily determined based on results of experiments or simulation. According to the present embodiment, TH1=220 degrees Celsius. The first temperature TH1 may be preferably any value within the range of 190 to 270 degrees Celsius, depending on characteristics of the heat fixing device 100, and be more preferably any value within the range of 200 to 230 degrees Celsius.

If the edge overheat has occurred, the control device 300 reduces the output of the halogen lamp 120. More specifically, the control device 300 reduces a duty ratio of pulse current supplied to the halogen lamp 120.

The control device 300 is configured to selectively perform either a first mode or a second mode as a print mode. When the edge overheat does not occur, the control device 300 performs the first mode in which a plurality of sheets 51 are supplied at first intervals T10. On the other hand, when the edge overheat occurs, the control device 300 performs the second mode in which a plurality of sheets 51 are supplied at second intervals T11 longer than the first intervals T10. That is, when the edge overheat occurs, the control device 300 controls the conveyance mechanism M1 to delay the conveyance timing of the sheets 51.

In the first mode, the time from the conveyance of the sheet 51 to the conveyance of the subsequent sheet 51 is set to the first interval T10. The first intervals T10 can be arbitrarily determined based on results of experiments, simulation, or the like.

In the second mode, the time from the conveyance of the sheet 51 to the conveyance of the subsequent sheet 51 is set to the second interval T11. More specifically, the control device 300 controls the conveyance mechanism M1 to convey the sheet 51 in the second mode after the second interval T11 has elapsed since the start of the conveying of the previous sheet 51. The second interval T11 is a period of time larger than or equal to the time required for the heat to be transferred from the right and left end portions of the fusing belt 110 toward the central portion thereof upon the occurrence of the edge overheat. The second interval T11 can be arbitrarily determined based on results of experiments or simulation. Incidentally, the control device 300 of the present embodiment is initially set in the first mode. When the edge overheat has occurred in the initial state or in the first mode, the control device 300 then changes the print mode from the first mode to the second mode.

The control device 300 control the motor 400 to be continuously turned ON, i.e., rotates the fusing belt 110 so as to follow the rotation of the pressure roller 150, and control the conveyance mechanism M1 not to supply the sheet 51 during the second interval T11 of the second mode. Therefore, when the edge overheat has occurred, the rotation of the fusing belt 110 has been continued to agitate the air, thereby dispersing the heat. The situation where the control device 300 controls the conveyance mechanism M1 not to supply the sheet 51 means the conveyance mechanism M1 suspends or forbids the supply of sheets 51 after the control device receives the print command.

When a sheet 51 having a width larger than or equal to a predetermined width W in the right-left direction is to be printed, the control device 300 determines whether the end-portion temperature TS obtained from at least one of side thermistors 180 is lower than or equal to a second temperature TH2 lower than the target temperature TH0 after a predetermined time T00 has elapsed since the halogen lamp 120 is turned ON. The second temperature TH2 is a temperature at which the favorable heat fixing cannot be performed. The second temperature TH2 can be arbitrarily determined based on results of experiments or simulation. The predetermined time T00 is, for example, the time required for the end-portion temperature TS and the center temperature TC to rise to the target temperature TH0 after the halogen lamp 120 is turned ON in a low-temperature environment. The predetermined time T00 can be arbitrarily determined based on results of experiments or simulation. The predetermined width W is larger than the minimum paper width W2 and smaller than the maximum paper width W1. According to the present embodiment, TH2=160 degrees Celsius. The second temperature TH2 may be preferably any value within the range of 130 to 200 degrees Celsius, depending on characteristics of the heat fixing device 100, and be more preferably any value within the range of 150 to 180 degrees Celsius.

If the end-portion temperature TS is lower than or equal to the second temperature TH2, the control device 300 increases the output of the halogen lamp 120. More specifically, the control device 300 increases a duty ratio of pulse current supplied to the halogen lamp 120.

When a sheet 51 having a width larger than or equal to the predetermined width W in the right-left direction is to be printed, the control device 300 determines whether the end-portion temperature TS obtained from at least one of side thermistors 180 is larger than or equal to a third temperature TH3 lower than the target temperature TH0 after the predetermined time T00 has elapsed since the halogen lamp 120 is turned ON. In this case, the third temperature TH3 of the present embodiment is a temperature within a range higher than the second temperature TH2 and slightly lower than the target temperature TH0. The third temperature TH3 can be arbitrarily determined based on results of experiments or simulation. The third temperature TH3 may be equal to the second temperature TH2. According to the present embodiment, TH3=170 degrees Celsius. The third temperature TH3 may be preferably any value within the range of 140 to 210 degrees Celsius, depending on characteristics of the heat fixing device 100, and be more preferably any value within the range of 160 to 190 degrees Celsius.

When the end-portion temperature TS is larger than or equal to the third temperature TS3, the control device 300 controls the conveyance mechanism M1 to start conveying a sheet 51, that is, the pickup roller 52 conveys the sheet 51.

Figure 5:
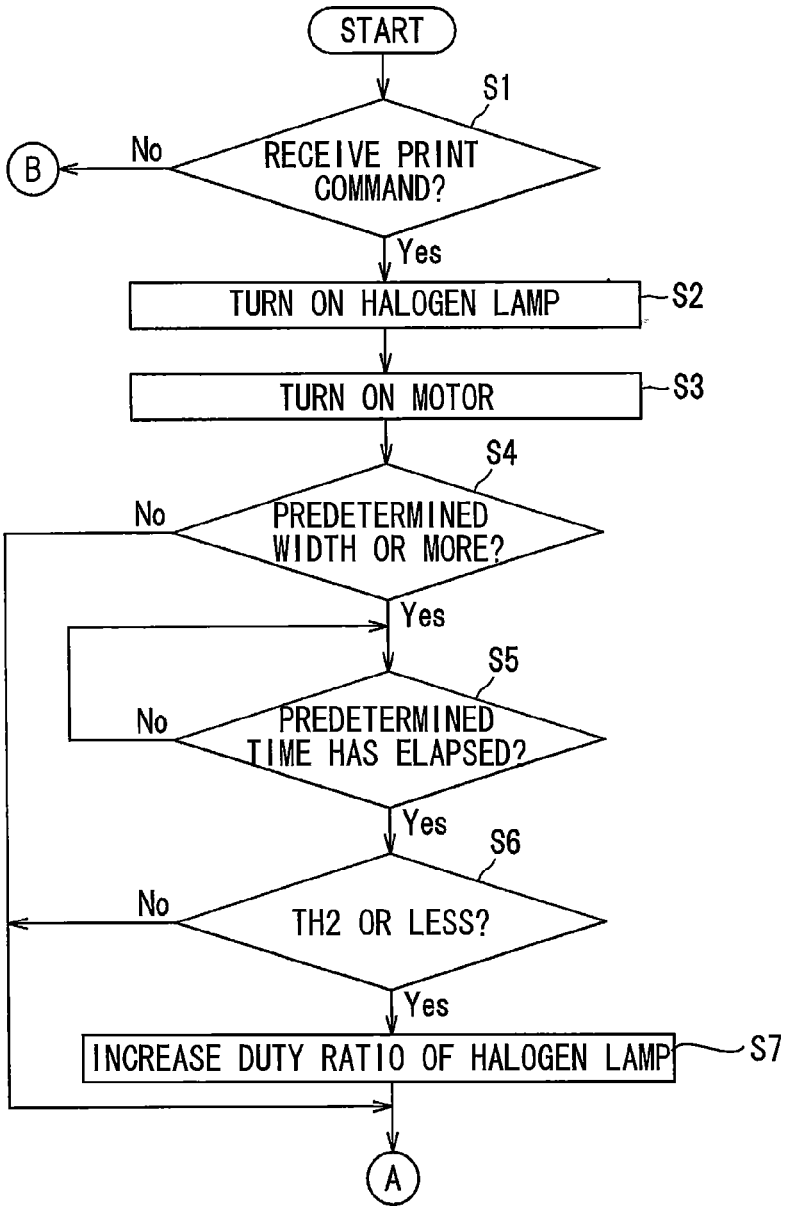
FIG. 5 is a flowchart illustrating an operation of a control device.
Figure 6:
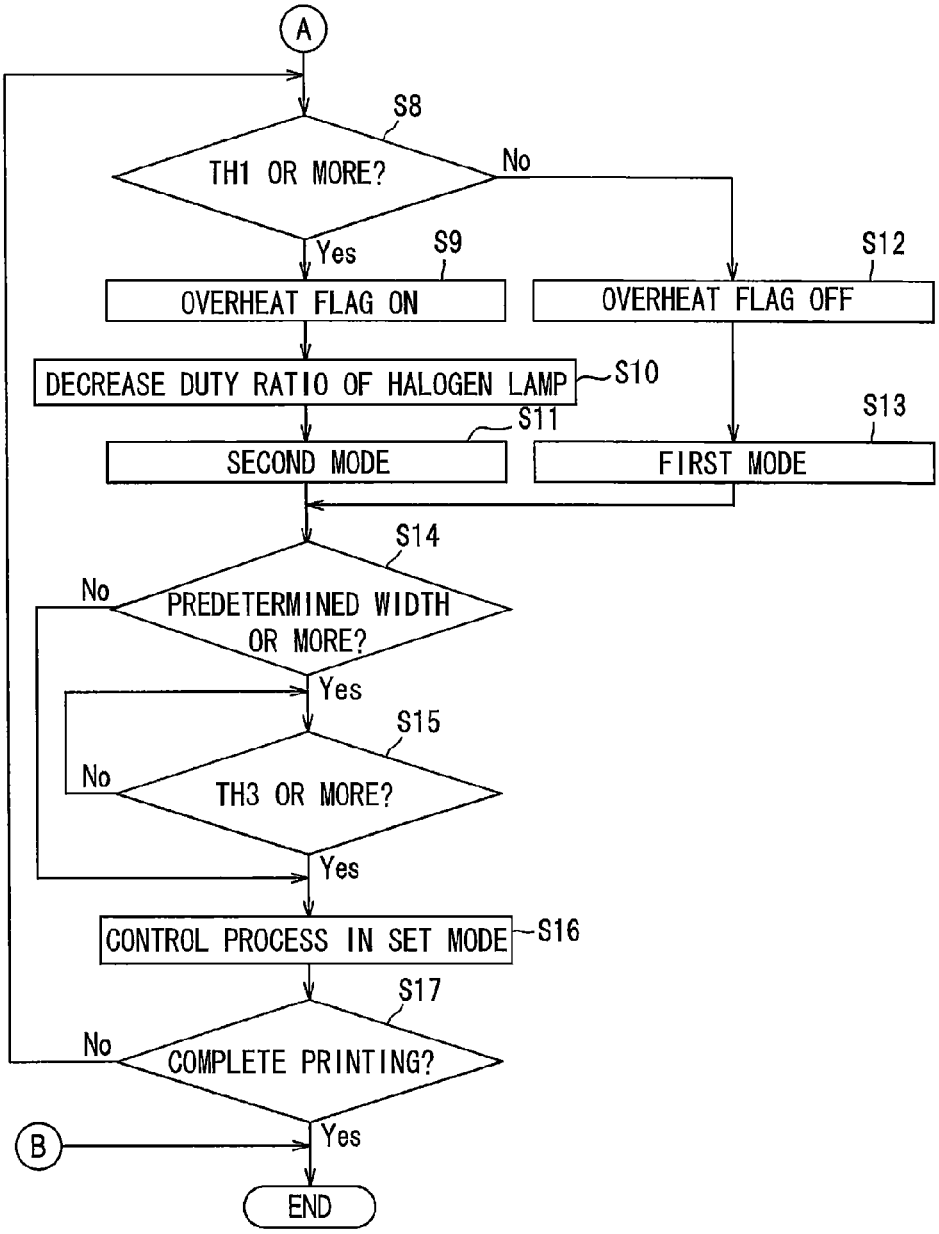
FIG. 6 is a flowchart illustrating the operation of the control device.

The control device 300 having the above configuration performs the control processes in accordance with a flowchart shown in FIGS. 5 and 6. The halogen lamp 120 is basically controlled by a normal control process in which the detection temperature of the center thermistor 210 is maintained substantially constant based on signals from the center thermistor 210. Upon starting a temperature control process shown in FIGS. 5 and 6 for controlling the halogen lamp 120, the temperature control process is applied instead of the normal control process. At the time of print operation, the process returns to the normal control process.

As shown in FIG. 5, the control device 300 determines whether to receive a print command (S1). If not (S1: No), then the control device 300 ends the temperature control process (See FIG. 6). If so (S1: Yes), the halogen lamp 120 is turned ON (S2), and then the motor 400 is turned ON after a predetermined small amount of time has elapsed from step S2 (S3). The output of the halogen lamp 120 at step S2 is smaller than a maximum output thereof.

After step S3, the control device 300 determines whether the width of the sheet 51 is larger than or equal to the predetermined width W (S4). If the width of the sheet 51 is larger than or equal to the predetermined width W (S4: Yes), then the control device 300 determines whether the predetermined time T00 of time has elapsed (S5). At step S5, if the predetermined time T00 of time has not elapsed (S5: No), the process of step S5 is repeatedly performed.

If the predetermined time T00 of time has elapsed (S5: Yes), the control device 300 determines whether the end-portion temperature TS is lower than or equal to the second temperature TH2 (S6). If the end-portion temperature TS is lower than or equal to the second temperature TH2 (S6: Yes), the control device 300 increases the duty ratio of pulse current supplied to the halogen lamp 120, i.e., the output of the halogen lamp 120 (S7).

If the width of the sheet 51 is not larger than or equal to the predetermined width W (S4: No), or if the end-portion temperature TS at step S6 is not lower than or equal to the second temperature TH2 (S6: No), or after the process of step S7 is performed, as shown in FIG. 6, the control device 300 determines whether the end-portion temperature TS is larger than or equal to the first temperature TH1 (S8).

At step S8, if the end-portion temperature TS is larger than or equal to the first temperature TH1 (S8: Yes), the control device 300 determines that the edge overheat has occurred, sets an overheat flag ON (S9), and then decreases the duty ratio of pulse current supplied to the halogen lamp 120 (S10). The control device 300 set the print mode to the second mode (S11).

In step S8, if the end-portion temperature TS is not larger than or equal to the first temperature TH1 (S8: No), the control device 300 sets the overheat flag OFF (S12) and sets the print mode to the first mode (S13).

After step S11 and step S13, the control device 300 determines whether the width of the sheet 51 is larger than or equal to the predetermined width W (S14). If the width of the sheet 51 is larger than or equal to the predetermined width W (S14: Yes), the control device 300 determines whether the end-portion temperature TS is larger than or equal to the third temperature TH3 (S15). If the end-portion temperature TS is not larger than or equal to the third temperature TH3 (S15: No), the control device 300 repeatedly performs step S15. If the end-portion temperature TS is larger than or equal to the third temperature TH3 (S15: Yes), the control device 300 performs a print control process in the print mode set in step S11 or S13 (S16). In step S16, one paper sheet is printed under the print control process among the paper sheets specified by the print command. In step S14, if the width of the sheet 51 is not larger than or equal to the predetermined width W (S14: No), the control device 300 performs the process of step S16 without carrying out the process of step S15.

After step S16, the control device 300 determines whether or not all sheets specified by the print command have been completely printed (S17). If the printing for the print command is not yet completed (S17: No), the control device 300 returns to the process of step S8. If the printing for the print command is completed (S17: Yes), the control device 300 ends the print control process.

Figure 7:
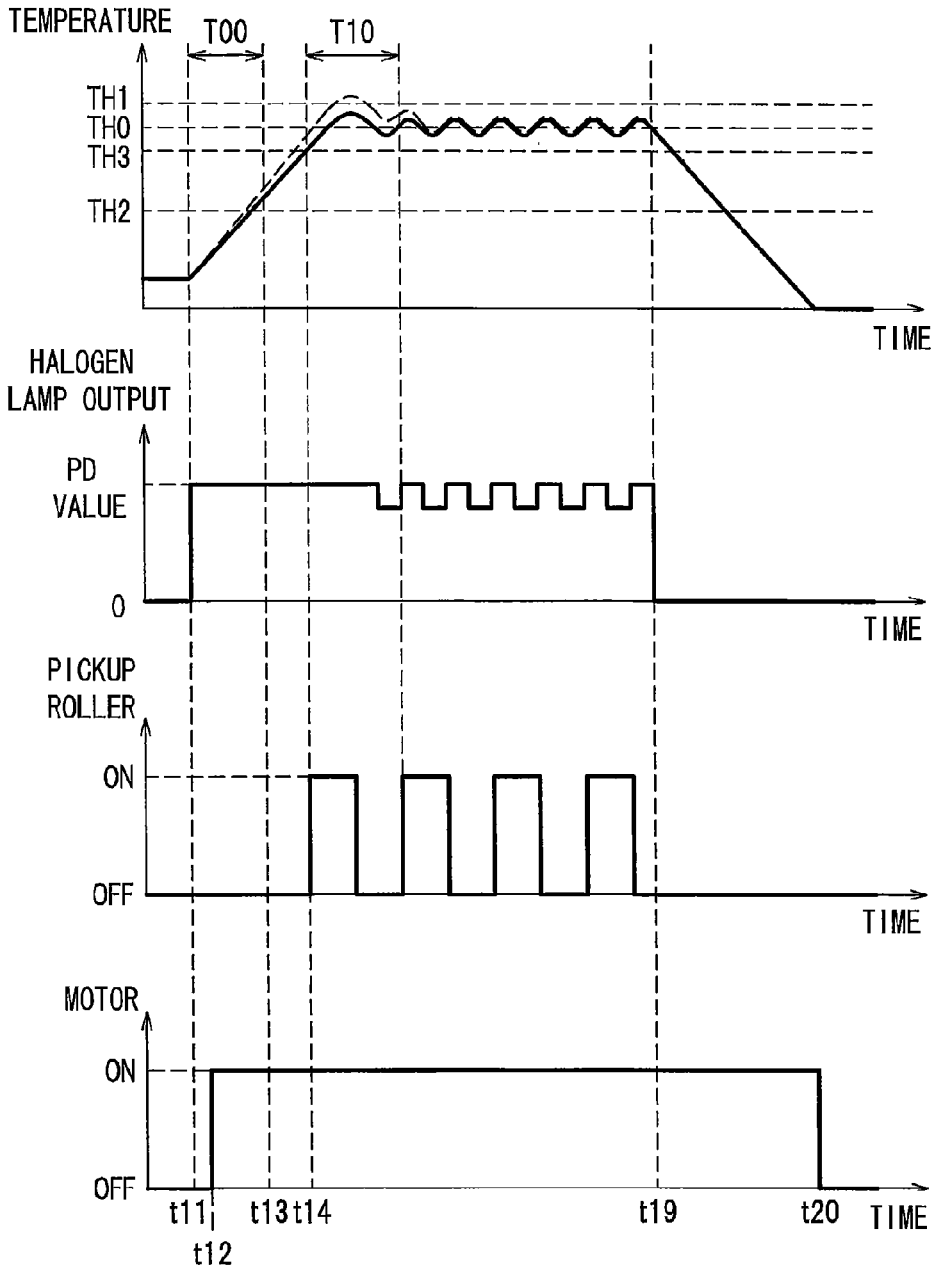
FIG. 7 is a time chart of each parameter when a temperature of an end portion of an endless belt is larger than a second temperature and lower than a third temperature after a predetermined time has elapsed from a reception of a printing command for printing a plurality of sheets having a width lager than a predetermined width.
Figure 8:
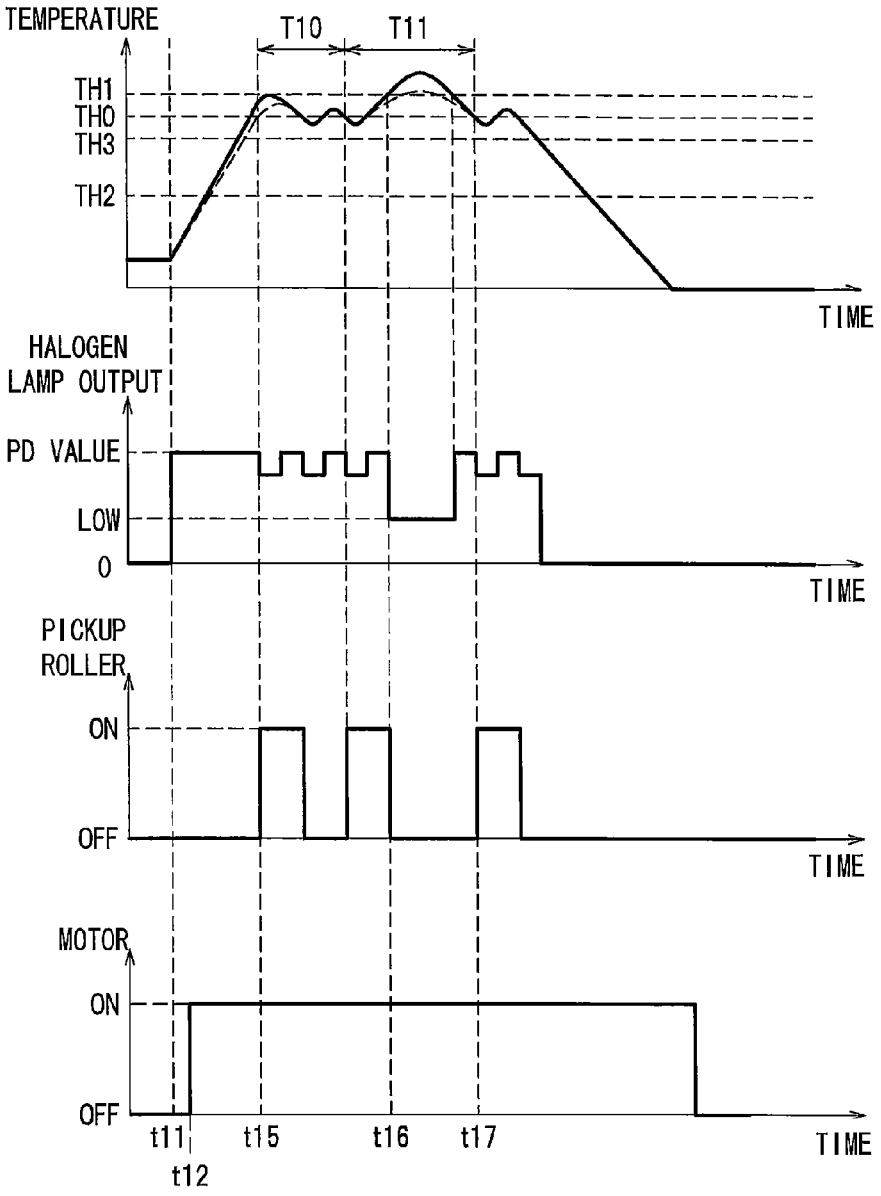
FIG. 8 is a time chart of each parameter when a second mode is performed during a printing control based on a printing command for printing a plurality of sheets having a width smaller than the predetermined width.
Figure 9:
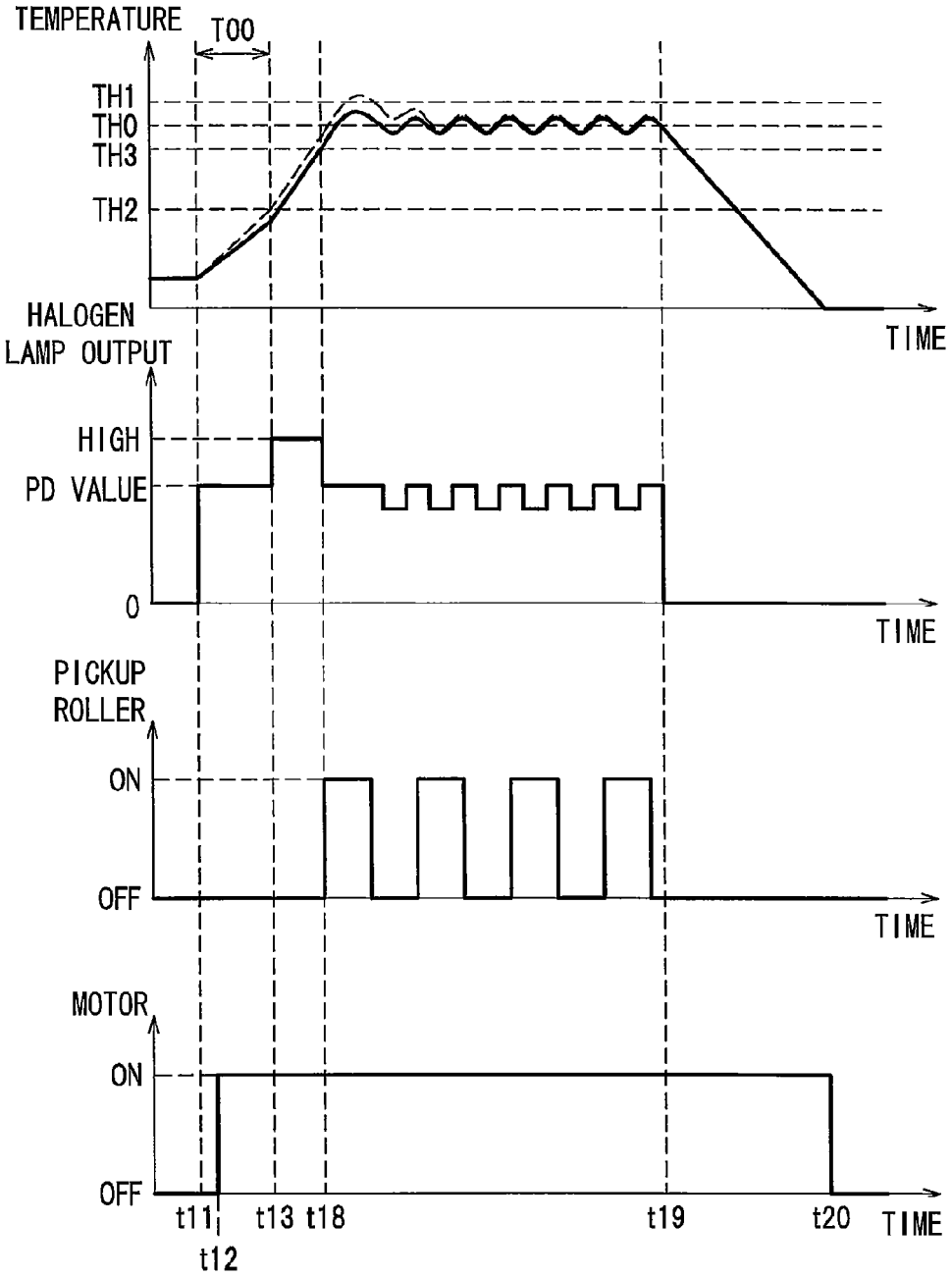
FIG. 9 is a time chart of each parameter when the temperature of the end portion is smaller than or equal to the second temperature after the predetermined time has elapsed from the reception of the printing command for printing a plurality of sheets having a width lager than the predetermined width.

With reference to FIG. 7, changes of each parameter over time will be described in a state where the end-portion temperature TS is larger than the second temperature TH2 and lower than the third temperature TH3 after the predetermined time T00 of time has passed since the control device 300 receives the print command for printing a plurality of sheets 51 having a width larger than or equal to the predetermined width W. In FIGS. 7 to 9, the end-portion temperature TS is indicated by solid line, and the center temperature TC by dashed line.

When the control device 300 receives the print command (time t11), the halogen lamp 120 is turned ON and the output of the halogen lamp 120 is set to predetermined value (PD value), and subsequently the motor 400 is turned ON (time t12). When the predetermined time T00 has elapsed from time t11 (time t13), the output of the halogen lamp 120 is maintained at the predetermined value if the end-portion temperature TS is larger than the second temperature TH2. If the end-portion temperature TS is lower than the third temperature TH3, the conveyance of the sheet 51 by the pickup roller 52 is suspended until the end-portion temperature TS reaches the third temperature TH3 (time t13 to t14). The end-portion temperature TS and the center temperature TC gradually rise due to the constant output of the halogen lamp 120.

After the end-portion temperature TS reaches the third temperature TH3 (time t14), the pickup roller 52 conveys the sheets 51 at the first intervals T10 in the first mode. The control device 300 controls the halogen lamp 120 to maintain the center temperature TC at the target temperature TH0 by adjusting the output of the halogen lamp 120 from time t14 to time t19. After the print control process comes to an end (time t19), the halogen lamp 120 is turned OFF, and thereafter the motor 400 is turned OFF (time t20).

With reference to FIG. 8, changes of each parameter over time will be described when the control device 300 sets the print mode to the second mode during the print control process based on print command for printing a plurality of sheets 51 having a width smaller than the predetermined width W.

If the end-portion temperature TS is lower than the first temperature TH1 after the print command is received at time t11 and the center temperature TC reaches the target temperature TH0, the control device 300 performs the first mode (time t15). In this case, the sheets 51 are conveyed at the first intervals T10. Then, if the end-portion temperature TS becomes larger than or equal to the first temperature TH1 (time t16), the output of the halogen lamp 120 is set to low, and the control device 300 set the print mode to the second mode. At this time, no sheets 51 are conveyed during the second interval T11 longer than the first interval T10, while the motor 400 has continuously driven. As a result, the rotation of the fusing belt 110 stirs the air, thereby dispersing the heat in the end portion thereof. Furthermore, as the output of the halogen lamp 120 becomes smaller, the end-portion temperature TS and the center temperature TC gradually fall.

Then, at an appropriate timing during the second interval T11, the process returns to the control of the output of the halogen lamp 120 based on the center temperature TC (time t17). After that, as in the case of FIG. 7, the print control process comes to an end.

With reference to FIG. 9, changes of each parameter over time will be described when the end-portion temperature TS is lower than or equal to the second temperature TH2 after the predetermined time T00 has elapsed since the control device 300 receives the print command for printing a plurality of sheets 51 having a width larger than or equal to the predetermined width W.

If the end-portion temperature TS is lower than or equal to the second temperature TH2 after the predetermined time T00 of time has elapsed since the print command is received, the control process is performed based on the end-portion temperature TS, and the output of the halogen lamp 120 is set to high (time t13). In response to increasing the output of the halogen lamp 120, an increase ratio of the end-portion temperature TS and the center temperature TC, i.e., slope of the temperatures, gradually rise rather than before time t13. After the end-portion temperature TS reaches the third temperature TH3 (time t18), the process returns to the control of the output of the halogen lamp 120 based on the center temperature TC, e.g., the output of the halogen lamp 120 returns to the predetermined value, and then the conveyance of the sheets 51 starts. After that, as in the case of FIG. 7, the print control process comes to an end.

According to those described above, the present embodiment can achieve the following advantageous effects.

The side thermistors 180 are provided for detecting the temperature of the end portions of the fusing belt 110, allowing an edge overheat to be detected. Moreover, the occurrence of the edge overhead is determined based on signals from the side thermistors 180 provided at the internal space of the fusing belt 110 where heat is difficult to escape and thus temperature easily rises, thereby accurately detecting a rise in temperature at the end portions of the fusing belt 110. Moreover, the halogen lamp 120 is controlled based on signals from the center thermistor 210 provided outside the fusing belt 110, thereby accurately detecting the temperature of the outer peripheral surface 110B of the fusing belt 110.

The side thermistors 180 can accurately detect a rise in temperature at the end portions of the nip plate 130. Therefore, for example, the effects of heat on a resin member supporting the nip plate 130 can be reduced.

If the control device 300 determines that the temperature obtained from at least one of the side thermistors 180 is larger than or equal to the first temperature TH1, then the control device 300 determines that the edge overheat occurs and decreases the output of the halogen lamp 120. Therefore, this configuration can prevent an excessive rise in temperature in the end portions of the fusing belt 110.

If the control device 300 determines that the edge overheat occurs, the conveyance timing of the sheets 51 is delayed. Therefore, the heat at the end portions of the fusing belt 110 can be transferred to the central portion thereof before the subsequent sheet 51 is conveyed.

If the control device 300 determines that the edge overheat occurs, the rotation of the fusing belt 110 has been continued. The rotation of the fusing belt 110 agitates the air, dispersing the heat. Therefore, the heat in the internal space of the end portions of the fusing belt 110 can be reduced during the process of not feeding the sheets 51.

If the end-portion temperature TS of the fusing belt 110 is low after the predetermined time T00 has elapsed since the halogen lamp 120 is turned ON, the control device 300 increases the output of the halogen lamp 120. Therefore, when the sheet 51 having a width larger than or equal to the predetermined width W is printed, the end-portion temperature TS of the fusing belt 110 can easily become a suitable temperature.

If the end-portion temperature TS of the fusing belt 110 is low, no sheets 51 are conveyed. Therefore, when the sheet 51 having a width larger than or equal to the predetermined width W is printed, the end-portion temperature TS of the fusing belt 110 can easily become a suitable temperature.

While the invention has been described in detail with reference to the embodiment thereof, it would be apparent to those skilled in the art that various changes and modifications may be made therein without departing from the spirit of the invention. The same components as those in the above embodiment are represented by the same reference symbols, and will not be described again in the description below.

Figure 10A:
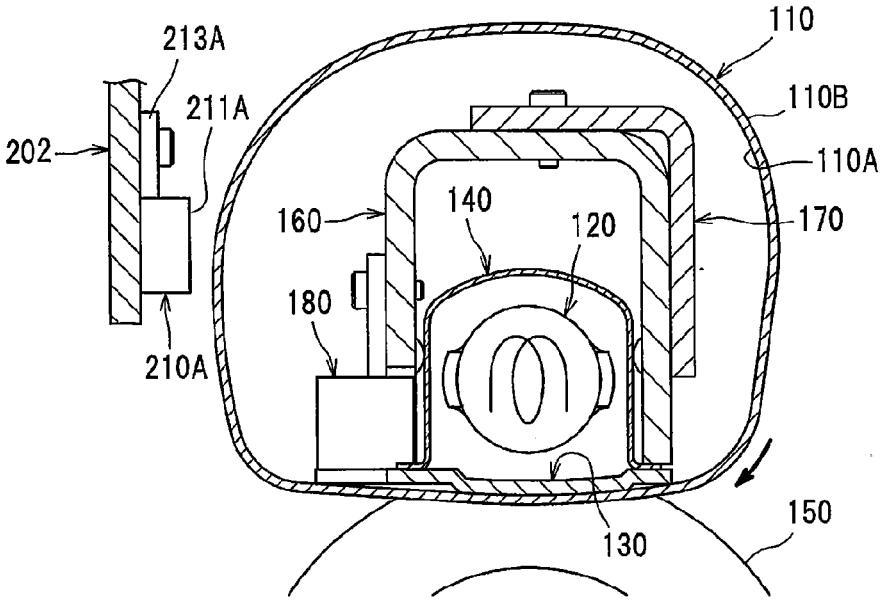
FIG. 10A is a cross-sectional view of a heat fixing device according to a first modification of the embodiment of the invention.

According to the above embodiment, the center thermistor 210 is placed on upstream side in the moving-direction of the fusing belt 110 relative to the pressure roller 150. However, the present invention is not limited to this configuration. For example, as shown in FIG. 10A, a fixing frame 202 extends rearward of the fusing belt 110. A center thermistor 210A may be placed on downstream side in the moving-direction of the fusing belt 110 relative to the pressure roller 150. The center thermistor 210A has an upper portion provided with a fixing rib 213A fixed to the rear wall of the fixing frame 200 with a screw. The center thermistor 210A has a front surface as a temperature detection surface 211A configured to detect a temperature of the outer peripheral surface 110B of the fusing belt 110.

Figure 10B:
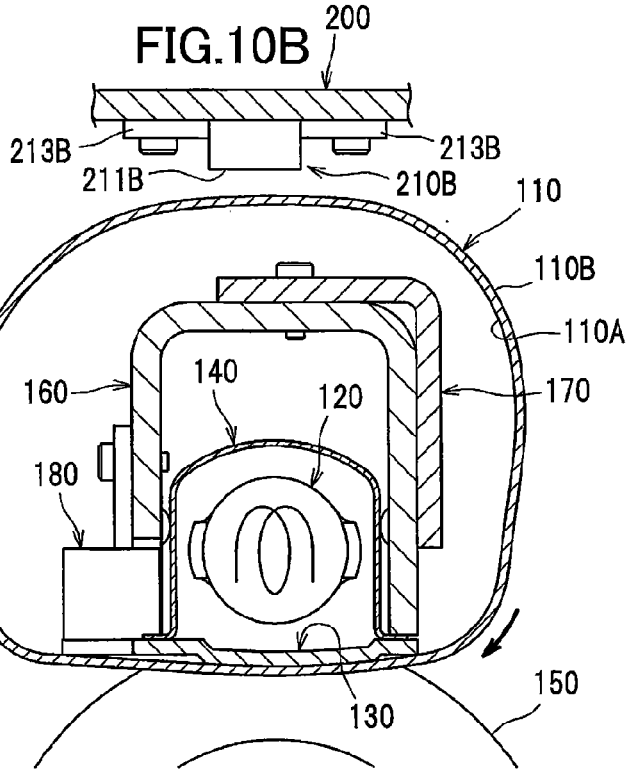
FIG. 10B is a cross-sectional view of a heat fixing device according to a second modification of the embodiment of the invention.

Alternatively, as shown in FIG. 10B, a center thermistor 210B may be placed on the opposite side of the nip N (pressure roller 150) with respect to the fusing belt 110. The center thermistor 210B has both end portions each provided with a fixing rib 213B fixed to the upper wall of the fixing frame 200 with screws. The center thermistor 210B has a bottom surface as a temperature detection surface 211B configured to detect a temperature of the outer peripheral surface 110B of the fusing belt 110.

Figure 11:
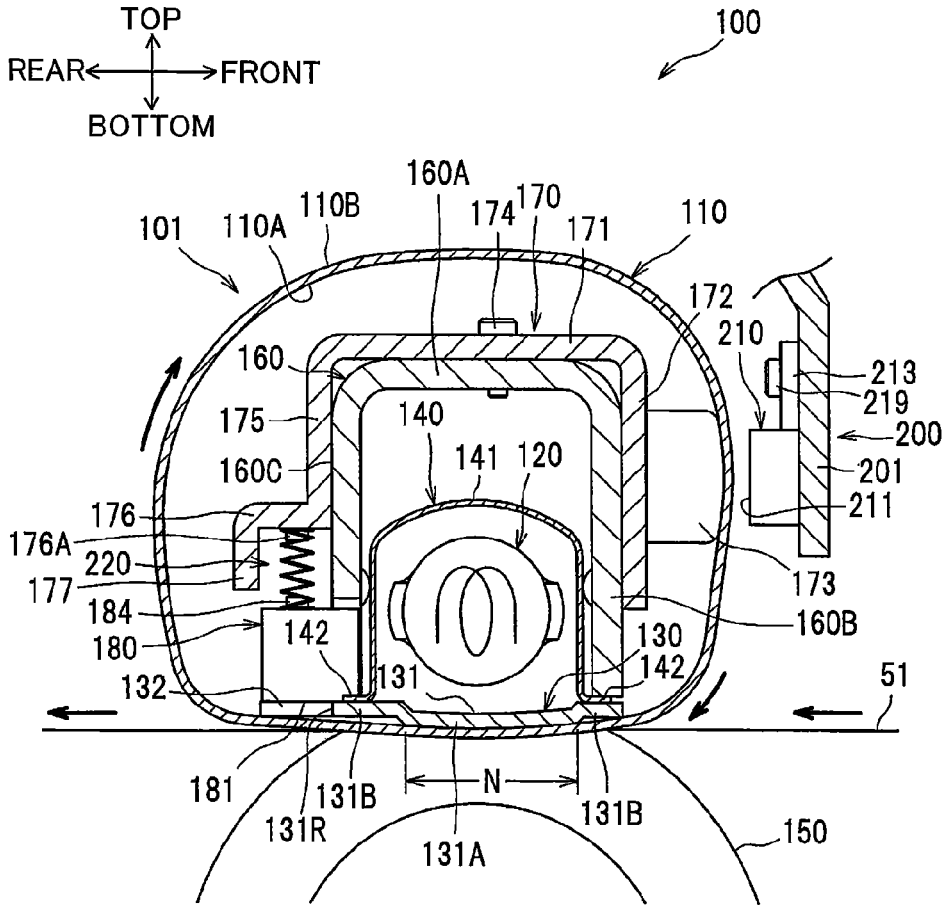
FIG. 11 is a cross-sectional view of a heat fixing device according to a third modification of the embodiment of the invention.

According to the above embodiment, the side thermistors 180 are fixed to the stay 160 with screws 189. However, the present invention is not limited to this configuration. For example, as shown in FIG. 11, a side thermistor 180 may be urged by a compression spring 220 toward the nip plate 130.

A cover member 170 in this configuration includes a rear wall 175, a support wall 176, and an extending wall 177 in addition to the configuration of FIG. 2. The rear wall 175 extends downward from a rear end of the upper-side wall 171, the support wall 176 extends rearward from a lower end of the rear wall 175, and the extending wall 177 extends downward from a rear end of the support wall 176. The compression spring 220 is provided between the support wall 176 and the side thermistor 180 placed on the nip plate 130. The compression spring 220 is held by a projection 176A extending downward from a lower surface of the support wall 176 and a projection 184 extending upward from an upper surface of the side thermistor 180. More specifically, the compression spring 220 is held by the projections 176A and 184 each inserted into the compression spring 220. The compression spring 220 presses the side thermistor 180 toward the nip plate 130. Therefore, the side thermistor 180 can detect the temperature of the nip plate 130.

According to the above embodiment, the control device 300 determines whether the edge overheat occurs based on the end-portion temperature TS obtained by at least one of side thermistors 180. However, the present invention is not limited to this configuration. For example, the control device 300 may be configured to determine whether the center temperature TC acquired from the center thermistor 210 is larger than or equal to a fourth temperature TH4 after the predetermined time T00 has elapsed since the control device 300 controls the halogen lamp 120 to be turned ON, and configured to determine whether the end-portion temperature TS obtained by at least one of side thermistors 180 is larger than or equal to the fourth temperature TH4.

If the control device 300 in this configuration determines that the center temperature TC is not larger than or equal to the fourth temperature TH4 after the predetermined time T00 has elapsed, and that the end-portion temperature TS is larger than or equal to the fourth temperature TH4, then the control device 300 performs a control process to determine that a failure (edge overheat) has occurred. In order to perform such a control process, the control device 300 determines whether the center temperature TC is not larger than or equal to the fourth temperature TH4, and whether the end-portion temperature TS is larger than or equal to the fourth temperature TH4 in step S8 of the flowchart shown in FIGS. 5 and 6. Only if the center temperature TC is not larger than or equal to the fourth temperature TH4, and the end-portion temperature TS is larger than or equal to the fourth temperature TH4, the control device 300 then proceeds to step S9. In other cases, the control device 300 may proceed to step S12.

According to the above embodiment, the control device 300 basically controls the halogen lamp 120 to maintain the output of the halogen lamp 120 constant until the center temperature TC reaches the target temperature TH0. However, the present invention is not limited to this configuration. For example, the control device may compare the center temperature acquired from the center thermistor with the target temperature. The control device may control the halogen lamp to increase the output thereof as a difference between the target temperature and the center temperature becomes larger. In this case, the halogen lamp may be controlled so as to increase or decrease the output thereof by changing the target temperature of the halogen lamp.

According to the above embodiment, the side thermistors 180 are provided at the internal space of both end portions of the fusing belt 110 in the right-left direction. Instead, a side thermistor 180 may be provided the internal space of only one end portions of the fusing belt 110 in the right-left direction. Moreover, the pair of side thermistors 180 is located outside of the maximum paper width W1 in the right-left direction. Instead, the pair of the side thermistors may be placed inside of the maximum paper width W1 and outside of the minimum paper width W2 in the right-left direction.

According to the above embodiment, the halogen lamp 120 is illustrated as one example of a heater. However, the present invention is not limited to this configuration. For example, the heater may be an IH (Induction Heating) heater or a ceramic heater. In this case, the IH heater is a device that does not generate heat by itself but uses an electromagnetic induction heating method to heat the metallic fusing belt and the nip plate.

According to the above embodiment, the first intervals T10 and the second intervals T11 are defined as time. Instead, for example, a distance between sheets may be employed.

According to the above embodiment, the thermostat is illustrated as an overheat prevention member. However, the present invention is not limited to this configuration. For example, a fuse may be used.

According to the above embodiment, the pressure roller 150 is illustrated as one example of a rotation member. However, the present invention is not limited to this configuration. For example, a belt-like member may be used.

According to the above embodiment, the nip plate 130 is illustrated as a nip member. However, the present invention is not limited to this configuration. For example, a thick member that is not a plate may be used as the nip member.

According to the above embodiment, the present invention is applied to the color laser printer 1. However, the present invention is not limited to this configuration. The present invention may be applied to other image formation devices, such as copying devices or multifunctional devices.

According to the above embodiment, sheets 51, such as cardboard, postcards, or thin paper, are illustrated as recording sheets. However, the present invention is not limited to those. For example, OHP sheets may be used.

According to the above embodiment, the control device 300 includes single CPU configured to perform the processes of FIGS. 5 and 6. However, the present invention is not limited to this configuration. The control device may include a plurality of CPUs configured to perform the processes of FIGS. 5 and 6, or may include a hardware circuit, such as ASIC (Application Specific Integrated Circuit) configured to perform the processes of FIGS. 5 and 6. The control device may include a CPU and a hardware circuit each configured to perform the processes of FIGS. 5 and 6.

What is claimed is:

1. An image forming apparatus comprising:

an endless belt configured to circularly move, the endless belt being elongated in a longitudinal direction and having a center portion and end portions in the longitudinal direction, and defining an internal space therein and an outer peripheral surface;

a heater extending inside the internal space of the endless belt;

a first temperature sensor positioned at the center portion and facing the outer peripheral surface of the endless belt;

a second temperature sensor positioned at one of the end portions and in the internal space of the endless belt;

a thermostat disposed in the internal space; and a wall having a plurality of ribs configured to guide an inner peripheral surface of the endless belt, wherein the first temperature sensor opposes one of the plurality of ribs relative to the endless belt in a direction perpendicular to the longitudinal direction of the endless belt, and wherein the second temperature sensor is spaced apart from each one of the plurality of ribs in the longitudinal direction of the endless belt.

2. The image forming apparatus according to claim 1, further comprising:

a nip member configured to contact the inner peripheral surface of the endless belt; and a rotation member configured to contact the outer peripheral surface of the endless belt and to sandwich the endless belt between the nip member and the rotation member, wherein the second temperature sensor faces the nip member.

3. The image forming apparatus according to claim 2, wherein the heater is disposed at the internal space to heat the endless belt.

4. The image forming apparatus according to claim 3, wherein the heater comprises a heating element and is separated from the nip member.

5. The image forming apparatus according to claim 1, further comprising a third temperature sensor positioned at another of the end portions and in the internal space.

6. The image forming apparatus according to claim 1, further comprising a rotation member configured to form a nip region between the endless belt and the rotation member, wherein the endless belt is configured to move in a moving direction at the nip region, and wherein the first temperature sensor is disposed at an upstream side of the nip region in the moving direction.

7. The image forming apparatus according to claim 1, further comprising a rotation member configured to form a nip region between the endless belt and the rotation member, wherein the endless belt is configured to move in a moving direction at the nip region, and wherein the first temperature sensor is disposed at a downstream side of the nip region in the moving direction.

8. The image forming apparatus according to claim 1, further comprising a rotation member configured to form a nip region between the endless belt and the rotation member, wherein the first temperature sensor is disposed opposite to the nip region with respect to the endless belt.

9. The image forming apparatus according to claim 1, wherein the first temperature sensor is separated from the endless belt.

10. The image forming apparatus according to claim 1, wherein the first temperature sensor contacts the endless belt.

11. The image forming apparatus according to claim 1, wherein the endless belt defines a maximum width in the longitudinal direction, and the image forming apparatus is configured to print a recording sheet having a width lower than or equal to the maximum width, and wherein the second temperature sensor is disposed outside of the maximum width in the longitudinal direction.

12. The image forming apparatus according to claim 11, further comprising a third temperature sensor positioned at another of the end portions and in the internal space, wherein the third temperature sensor is disposed outside of the maximum width in the longitudinal direction.

13. The image forming apparatus according to claim 1, further comprising a rotation member configured to form a nip region between the endless belt and the rotation member where a recording sheet is to be conveyed in a conveyance direction, wherein the thermostat is disposed upstream of the first temperature sensor in the conveyance direction.

14. The image forming apparatus according to claim 1, further comprising a rotation member configured to form a nip region between the endless belt and the rotation member where a recording sheet is to be conveyed in a conveyance direction, wherein the thermostat is disposed downstream of the first temperature sensor in the conveyance direction.

15. The image forming apparatus according to claim 1, wherein the thermostat is aligned along the longitudinal direction with the second temperature sensor.

16. A heat fixing device comprising:

an endless belt configured to circularly move, the endless belt being elongated in a longitudinal direction and having a center portion and end portions in the longitudinal direction, and defining an internal space therein, an inner peripheral surface, and an outer peripheral surface;

a nip member configured to contact the inner peripheral surface of the endless belt;

a rotation member, the nip member and the rotation member being configured to nip the endless belt therebetween such that the rotation member and the endless belt form a nip region therebetween where a recording sheet is to be conveyed in a conveyance direction;

a first temperature sensor positioned at the center portion and facing the outer peripheral surface;

a second temperature sensor positioned at one of the end portions and in the internal space, the second temperature sensor and the first temperature sensor being positioned downstream of the nip region in the conveyance direction; and a wall having a plurality of ribs configured to guide the inner peripheral surface of the endless belt, the first temperature sensor overlapping with one of the plurality of ribs when viewed from a direction perpendicular to the longitudinal direction of the endless belt.

17. The heat fixing device according to claim 16, further comprising a thermostat disposed in the internal space.

18. The heat fixing device according to claim 17, wherein the thermostat is disposed upstream of the first temperature sensor in the conveyance direction.

19. The heat fixing device according to claim 17, wherein the thermostat is disposed downstream of the first temperature sensor in the conveyance direction.

20. The heat fixing device according to claim 17, wherein the thermostat is aligned along the longitudinal direction with the second temperature sensor.

21. A heat fixing device comprising:

an endless belt configured to circularly move, the endless belt being elongated in a longitudinal direction and having a center portion and end portions in the longitudinal direction, and defining an internal space therein, an inner peripheral surface, and an outer peripheral surface;

a nip member configured to contact the inner peripheral surface of the endless belt;

a rotation member, the nip member and the rotation member being configured to nip the endless belt therebetween such that the rotation member and the endless belt form a nip region therebetween where a recording sheet is to be conveyed in a conveyance direction;

a first temperature sensor positioned at the center portion and facing the outer peripheral surface;

a second temperature sensor positioned at one of the end portions and in the internal space, the second temperature sensor being positioned downstream of the first temperature sensor in the conveyance direction; and a wall having a plurality of ribs configured to guide the inner peripheral surface of the endless belt, wherein a first group of distances is provided between the first temperature sensor and each one of the plurality of ribs in the longitudinal direction, a first shortest distance being defined among the first group of distances, and wherein a second group of distances is provided between the second temperature sensor and each one of the plurality of ribs in the longitudinal direction, a second shortest distance being defined among the second group of distances, the first shortest distance being different from the second shortest distance.

22. The heat fixing device according to claim 21, further comprising a thermostat disposed in the internal space.

23. The heat fixing device according to claim 22, wherein the thermostat is disposed upstream of the first temperature sensor in the conveyance direction.

24. The heat fixing device according to claim 22, wherein the thermostat is disposed downstream of the first temperature sensor in the conveyance direction.

25. The heat fixing device according to claim 22, wherein the thermostat is aligned along the longitudinal direction with the second temperature sensor.

26. The heat fixing device according to claim 21, wherein the first shortest distance is shorter than the second shortest distance.

27. The heat fixing device according to claim 26, wherein the first shortest distance is zero; and wherein the second shortest distance is greater than zero.

28. The heat fixing device according to claim 21, wherein the first temperature sensor has a length in the longitudinal direction, and the first group of distances is provided between a center of the first temperature sensor in the longitudinal direction and each one of the plurality of ribs in the longitudinal direction; and wherein the second temperature sensor has a length in the longitudinal direction, and the second group of distances is provided between a center of the second temperature sensor in the longitudinal direction and each one of the plurality of ribs in the longitudinal direction.

29. The heat fixing device according to claim 28, wherein an imaginary plane is spaced apart from each one of the plurality of ribs, the imaginary plane being perpendicular to the longitudinal direction of the endless belt and passing through a center of the second temperature sensor.

* * * * *